US007325949B1

(12) United States Patent
Wang

(10) Patent No.: US 7,325,949 B1
(45) Date of Patent: Feb. 5, 2008

(54) QUICK ASSEMBLING STRUCTURE FOR LED LAMP AND HEAT DISSIPATING MODULE

(75) Inventor: Pei-Choa Wang, Gueishan Township, Taoyuan County (TW)

(73) Assignee: Augux Co., Ltd., Taoyuan (TW)

( * ) Notice: Subject to any disclaimer, the term of this patent is extended or adjusted under 35 U.S.C. 154(b) by 49 days.

(21) Appl. No.: 11/465,204

(22) Filed: Aug. 17, 2006

(51) Int. Cl.
*F21V 29/00* (2006.01)

(52) U.S. Cl. ..... 362/373; 362/294; 362/249; 362/652

(58) Field of Classification Search ..... 362/373, 362/294, 652–653, 227, 249, 547
See application file for complete search history.

(56) References Cited

U.S. PATENT DOCUMENTS 5,537,301 A * 7/1996 Martich ..... 362/218
7,093,964 B2 * 8/2006 Bynum ..... 362/488
7,255,460 B2 * 8/2007 Lee ..... 362/294
2005/0122727 A1 * 6/2005 Machi et al. ..... 362/470
2007/0132092 A1 * 6/2007 Hu et al. ..... 257/712

* cited by examiner

*Primary Examiner*—Ali Alavi

(57) ABSTRACT

In a quick assembling structure for LED lamp and heat dissipating module, the LED lamp set includes a casing and an LED module, and the casing has a containing hole, a stopping member protruded from an internal edge of the containing hole, a plurality of support stands extended outward from an external edge of the containing hole, and a latch portion formed on an internal side of the support stand. The LED module is contained in the containing hole of the casing and includes a base board and a plurality of LEDs fixed onto the bottom of the base board, and the heat dissipating module has an isothermal board installed on a side of the support stand of the casing, and a surface of the isothermal board is attached onto the base board of the LED module, and another surface is latched to a latch portion of the support stand. Such arrangement not only greatly reduces the labor cost for the assembling process, but also lowers the material cost for the screws.

10 Claims, 6 Drawing Sheets

QUICK ASSEMBLING STRUCTURE FOR LED LAMP AND HEAT DISSIPATING MODULE

BACKGROUND OF THE INVENTION

1. Field of the Invention

The present invention relates to a quick assembling structure for LED lamp and heat dissipating module, and more particularly to a quick assembling structure capable of reducing the time required for assembling an LED lamp set and a heat dissipating module.

2. Description of Prior Art

Since light emitting diodes (LEDs) feature the advantages of high brightness, power saving and long life expectancy, LEDs have been used extensively for the illumination of lamps. Several LEDs are usually arranged on a base board and connected with each other to form an LED module, and a plurality of LED modules are connected in series or in parallel to achieve an illumination effect to meet the requirements for a large projecting area and a high brightness. Since these LEDs come with a low heat resistance, a heat dissipating module is usually required for dissipating the heat produced by each LED, so that each LED can be operated at a lower temperature, and an LED lamp and a heat dissipating module are indispensable to each other. Therefore, it is an important subject for manufacturers in the related field to design a quick assembly for an LED lamp and a heat dissipating module.

In general, a traditional assembling structure for LED lamp set and heat dissipating body includes an LED lamp set and a heat dissipating body. The LED lamp set includes a casing, an LED module installed in the casing, an aluminum heat dissipating body attached onto the back of the LED module, a plurality of fixing holes disposed on the heat dissipating body, and a screw hole disposed on the casing and corresponding to the fixing hole. A fixing element such as a screw is passed through the fixing hole and screwed into the screw hole of the casing, so as to achieve the effect of combining the LED lamp set and the heat dissipating body.

However, the actual application of the prior art assembling structure for LED lamp set and heat dissipating body still has the following problems. Since the assembling process requires a fixing element such as a screw for the connection, the assembling process will be relatively slow, not only incurring a high labor cost, but also wasting a material cost for the screws. Such arrangement of the prior art significantly reduces the practicality and cost-effectiveness of the structure. Since the aluminum heat dissipating body does not have a high conductivity for conducting and dissipating the heat of the LED lamp set, therefore the heat dissipation effect is very limited. Particularly, after the high power LEDs are developed, the heat dissipation requirements of the current LED lamp sets cannot be satisfied at all, and the life expectancy of the LEDs in an LED lamp set is shortened significantly. These shortcomings of the prior art definitely require further improvements.

SUMMARY OF THE INVENTION

In view of the foregoing shortcomings of the prior art, the inventor of the present invention based on years of experience in the related industry to conduct experiments and modifications, and finally designed a quick assembling structure for an LED lamp and a heat dissipating module in accordance with the present invention.

Therefore, the present invention is to overcome the shortcomings of the prior art by providing a quick assembling structure for LED lamp and heat dissipating module that can be installed on a casing quickly by an LED module and an isothermal board. The invention not only reduces the labor cost required for the assembling process, but also lowers the material cost for a fixing element such as a screw.

The present invention provides a quick assembling structure for LED lamp and heat dissipating module that comprises an LED lamp set and a heat dissipating module, and the LED lamp set includes a casing and an LED module. The casing has a containing hole, a stopping member protruded from an internal edge of the containing hole, a plurality of support stands extended outward from an external edge of the containing hole, and corresponding latch portions formed on an internal side of the support stand. The LED module is contained in the containing hole of the casing and the LED module includes a base board and a plurality of LEDs fixed onto the bottom surface of the base board. The heat dissipating module has an isothermal board installed at a side of the support stand of the casing, and a surface of the isothermal board is attached onto the base board of the LED module and another surface is latched to the latch portion of the support stand.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings. However, the drawings are provided for reference and illustration only and are not intended for limiting the scope of the invention.

Referring to FIGS. 1 to 4 for a perspective view, a perspective view, a cross-sectional view and an enlarged view of Section A of the present invention, the invention provides a quick assembling structure for LED lamp and heat dissipating module that comprises an LED lamp set 1 and a heat dissipating module 5.

Figure 1:
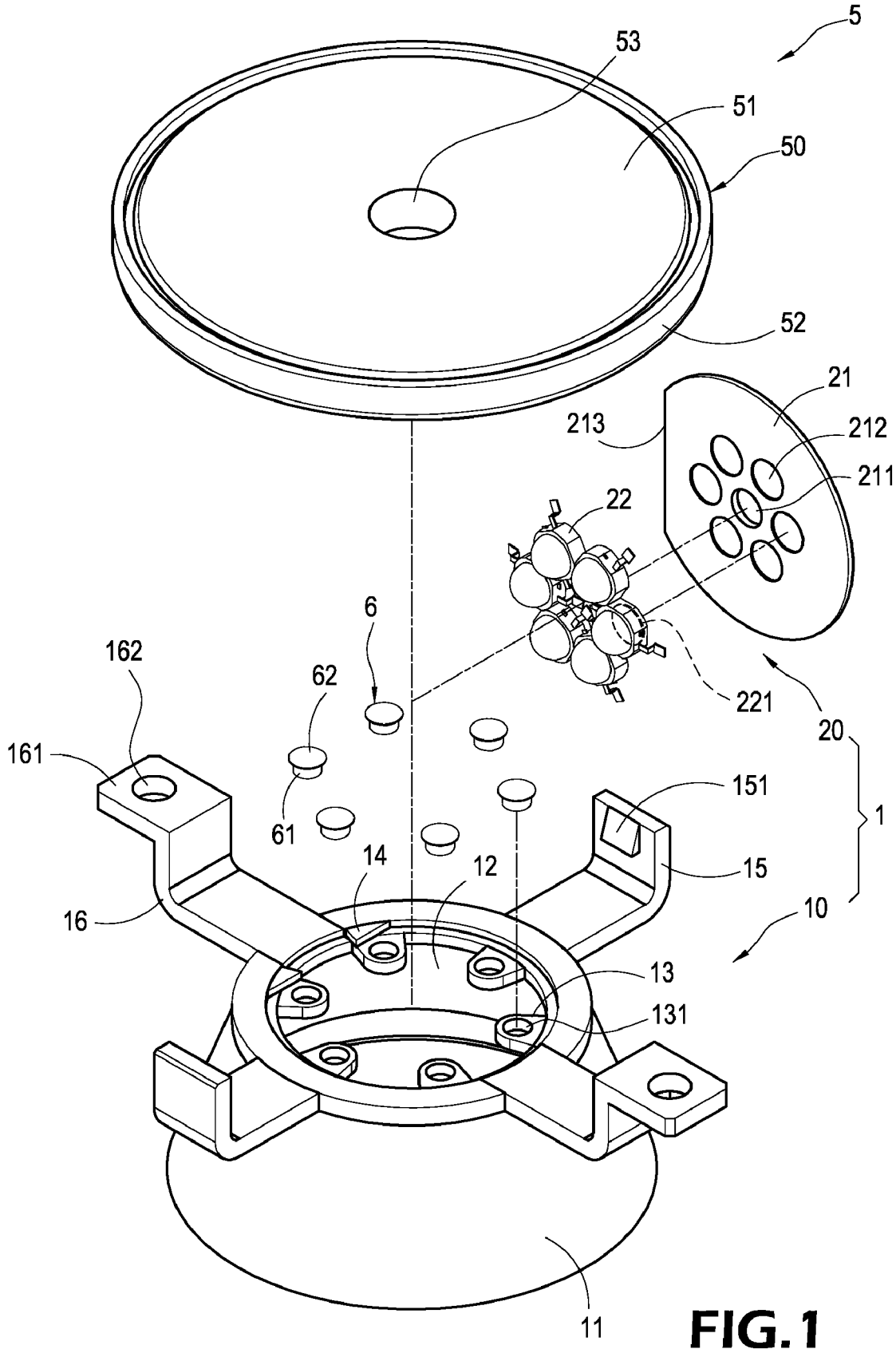
FIG. 1 is an exploded view of the present invention.
Figure 2:
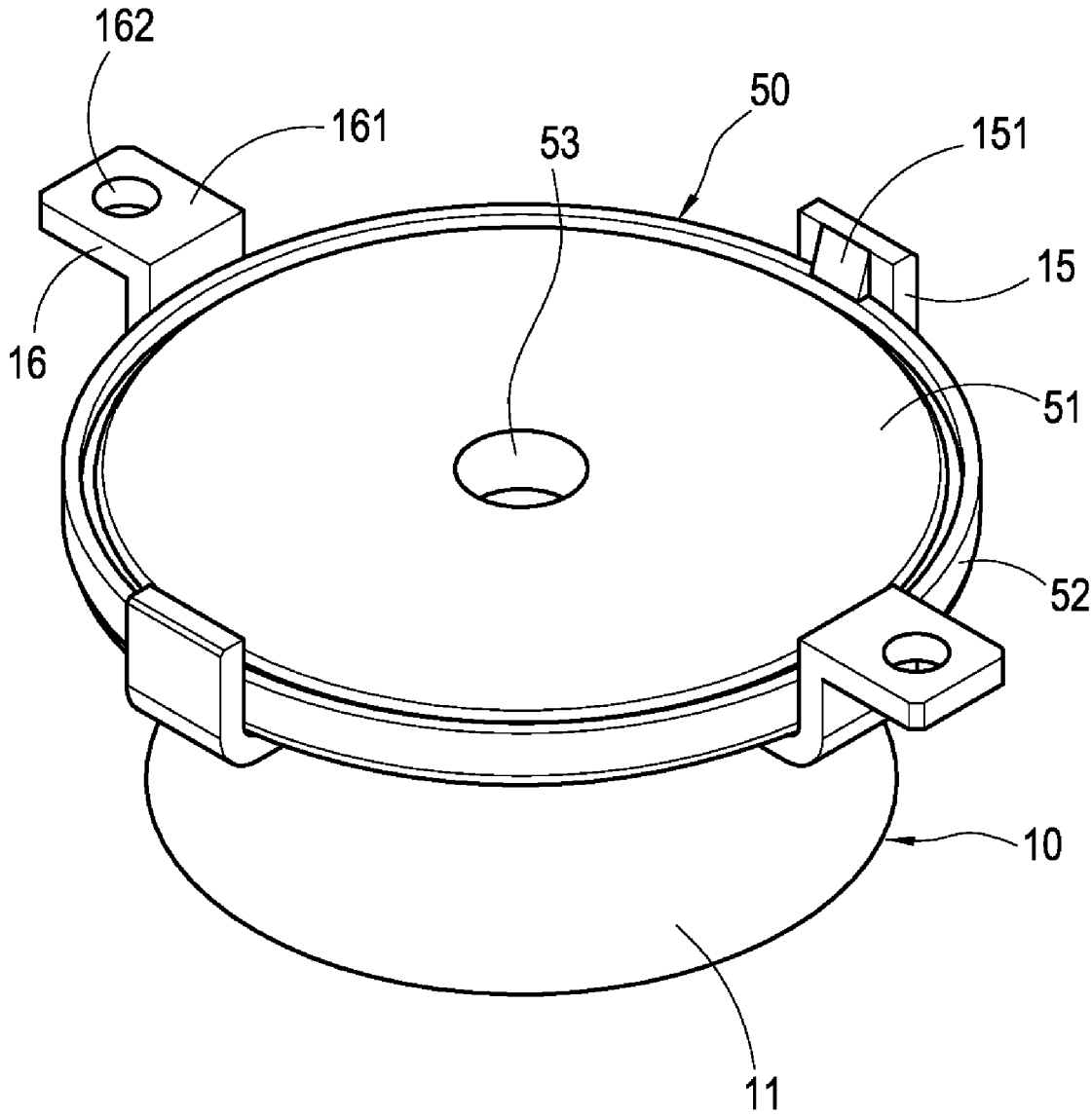
FIG. 2 is a perspective view of the present invention.
Figure 3:
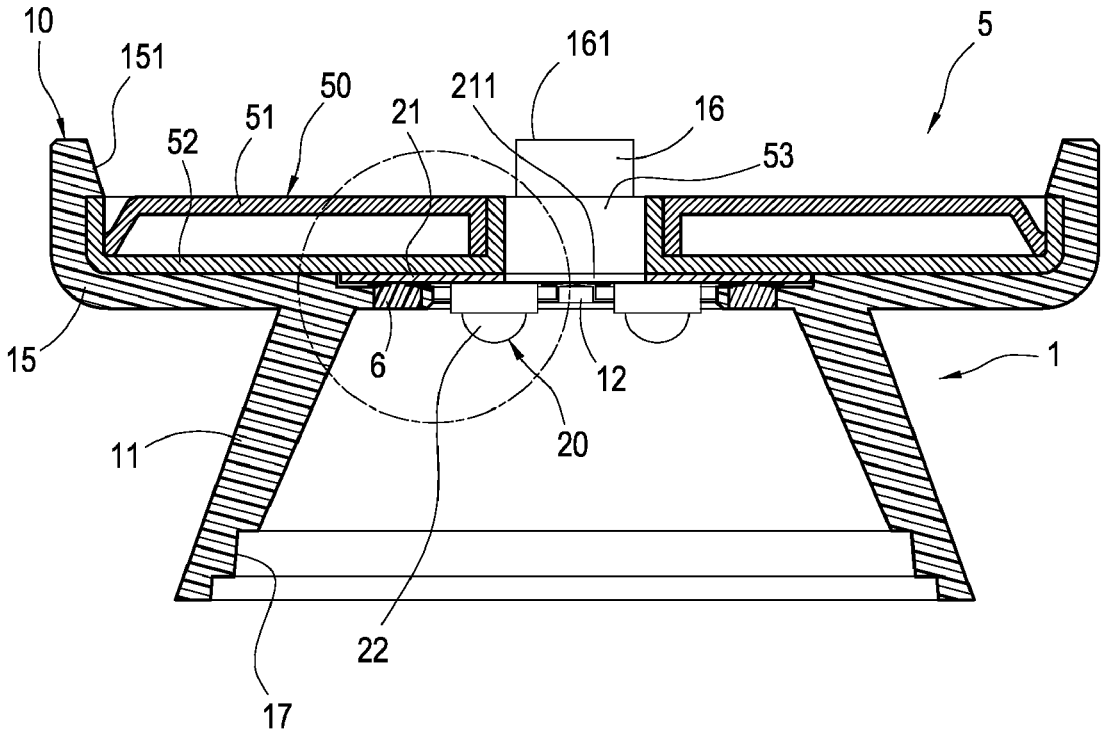
FIG. 3 is a cross-sectional view of the present invention.
Figure 4:
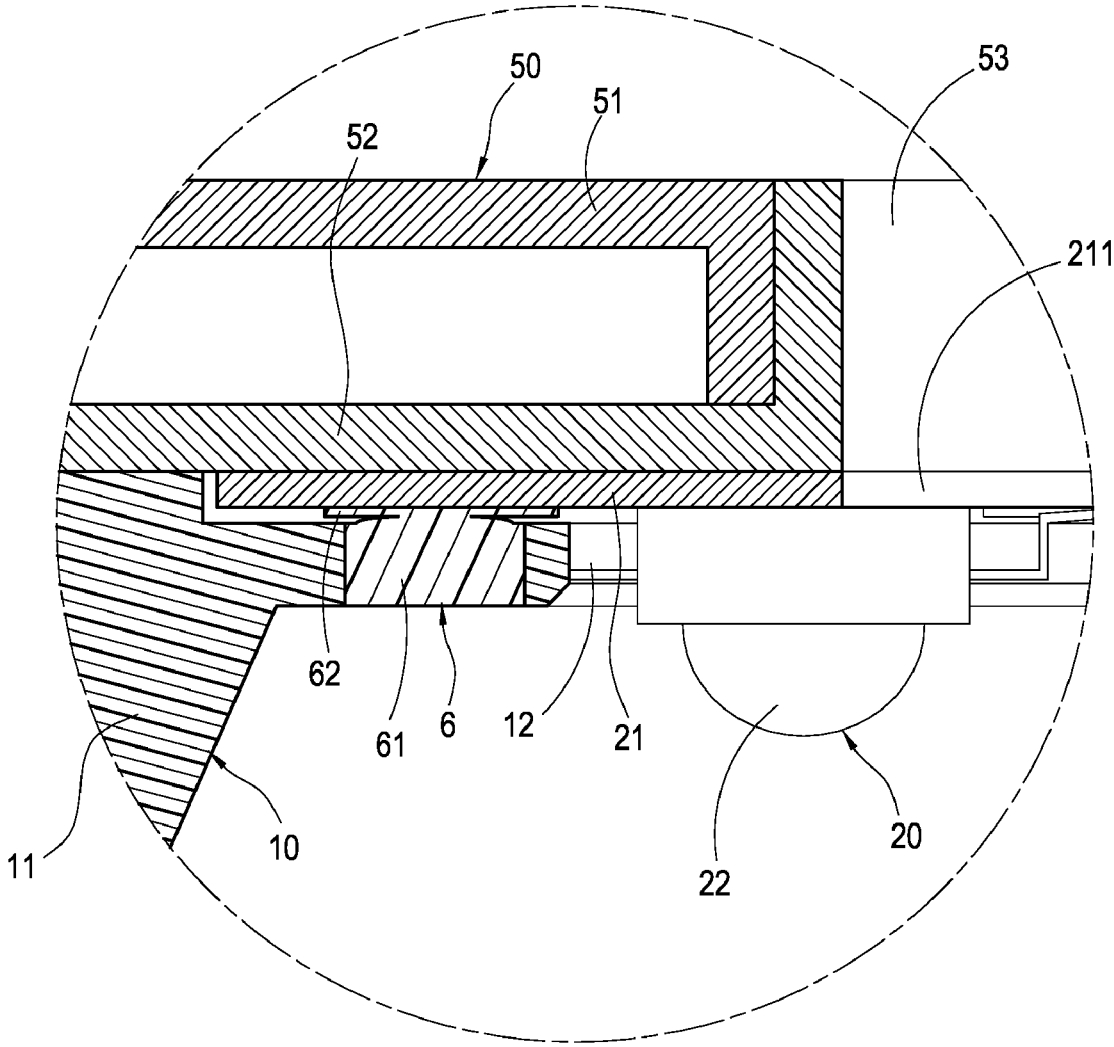
FIG. 4 is an enlarge view of Section A as depicted in FIG. 3.

The LED lamp set 1 includes a casing 10 and an LED module 20, and the casing 10 forms a cone 11 at the bottom of the casing 10, and the cone 11 forms a containing hole 12 at the top of the cone 11. A plurality of corresponding stopping members 13 are protruded from an internal edge of the containing hole 12, and each stopping member 13 includes a through hole 131, and each stopping member 13 includes a positioning member 14 extended from the left side of the containing hole 12, and two corresponding support stands 15 extended outward from the top surface of the cone 11. The support stand 15 is substantially in an L-shape, and its short arm has a latch portion 151 formed on the internal side. Two inverted L-shape fixing stand 16 are disposed between two support stands 15, and a slab 161 is extended horizontally from an end of the fixing stand 16, and a through hole 162 is disposed at the center of the slab 161, and the cone 11 has a stairway ring 17 disposed at the bottom of the cone 11 as shown in FIG. 3.

The LED module 20 is contained in the containing hole 12 of the casing 10 and the LED module 20 includes a base board 21 and a plurality of LEDs 22 fixed onto the bottom surface of the base board 21, a center hole 211 disposed at the middle of the base board 21, and a plurality of fixing holes 212 disposed around the external periphery of the center hole 211. The base board 21 has a stopping surface 213 disposed on a side of the base board 21 and attached onto a positioning member 14 of the casing 10, such that the base board 21 will be rotated after the base board 21 is installed in the casing 10. A protruding pillar 221 is extended from the rear of each LED 22 and embedded and connected to the fixing hole 211 of the base board 21.

The heat dissipating module 5 has an isothermal board 50 installed onto a side of the support stand 15 of the casing 10, and one of the sides is attached and connected to the base board 21 of the LED module 20, and the other side is latched to the latch portion 151 of the support stand 15. To cope with the heat dissipating requirements of various different types of LED modules 20, a heat dissipating plate (not shown in the figure) improves the thermal conduction and dissipation of the heat dissipating module 5. The isothermal board 50 of this embodiment includes a circular upper plate 51 and a corresponding circular lower plate 52 engaged to the bottom of the upper plate 51, and capillary tissues and operating fluids are filled into the lower plate 51, 52 to form a vacuum chamber, such that the thermal conduction mechanism of the gas and liquid phases are used for achieving a quick heat conduction effect, and the center of the isothermal board 50 has a wiring hole 53, and a power cable (not shown in the figure) can be passed through the wiring hole 53 to the outside for an electric connection.

The structure of the present invention further includes a plurality of elastic bodies 6, each having a cylindrical fixing section 61 and a circular disc clamping section 62 expanded outward from the fixing section 61, and the fixing section 61 is embedded into the through hole 131 of the stopping member 13, and the clamping section 62 is clamped between the corresponding surfaces of the stopping member 13 and the base board 21 of the LED module 20, such that the isothermal board 50 and the base board 21 can be attached closely with each other to improve the heat conducting effect.

In the assembling process, the fixing section 61 of each elastic body 6 is installed into the through hole 131 of the stopping member 13, and then the LED module 20 is installed in the containing hole 12 of the casing 10, such that the bottom surface of the base board 21 of the LED module 20 is attached and coupled onto the top of the clamping section 62 of each elastic body 6, and then the isothermal board 50 corresponding to the LED module 20 is installed at the top of the casing 10 for pressing the isothermal board 50 to move downward, and the top surface of the isothermal board 50 is latched by the latch portion 151 of the support stand 15. Therefore, a quick assembling structure for the LED lamp set and the heat dissipating module can be achieved. The present invention not only reduces the labor cost required for the assembling process significantly, but also lowers the material cost for a fixing element such as a screw as well.

Figure 5:
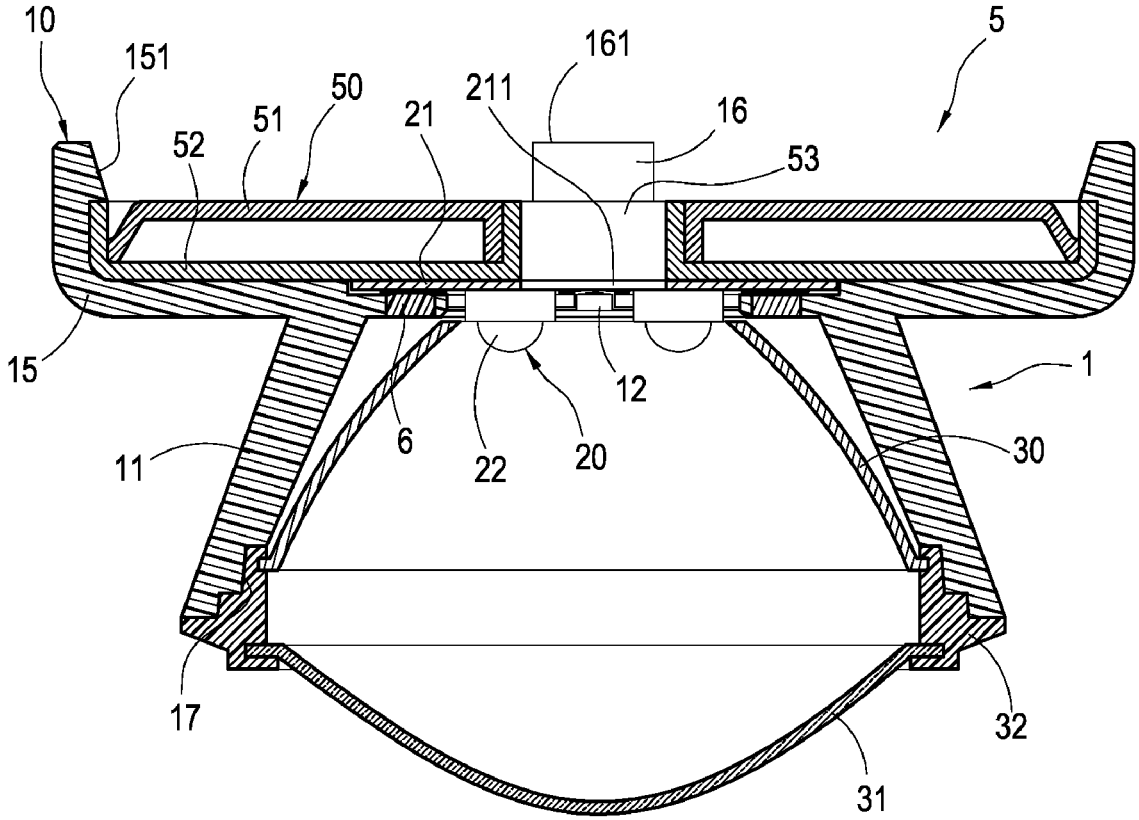
FIG. 5 is a cross-sectional view of a reflecting hood, a light transmitting lens and a fixing ring in accordance with the present invention.

Referring to FIG. 5 for a cross-sectional view of a reflecting hood, a light transmitting lens and a fixing ring in accordance with the present invention, the LED lamp set 1 further comprises a reflecting hood 30, a light transmitting lens 31 and a fixing ring 32. The reflecting hood 30 is substantially in a bowl shape for engaging the external periphery of the LED 22, and the external periphery of the light transmitting lens 31 is embedded to the interior of the fixing ring 32, and the fixing ring 32 is coupled to the stairway ring 17 of the casing 10 by a glue.

When the LED lamp is turned on, a current passes through the LED module 20, such that each LED 22 emits light and produces heat, and the heat is conducted from the base board 21 to the isothermal board 50, and the fluid phased heat conduction mechanism of the isothermal board 50 brings the heat to the top quickly and exchanges the heat with external cold air, and thus each LED 22 can be operated at a lower temperature and the life expectancy of the LED 22 can be extended.

Figure 6:
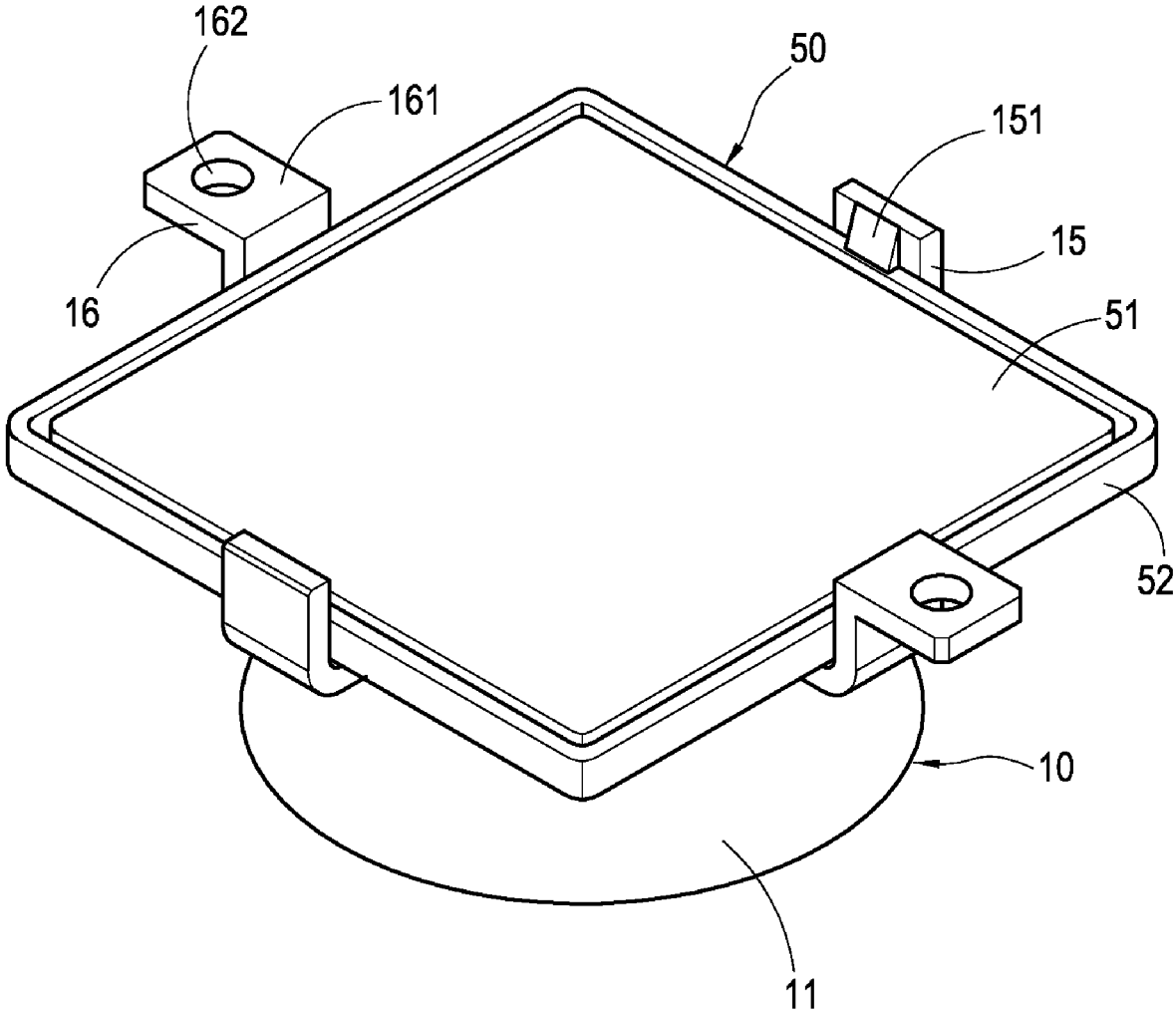
FIG. 6 is a perspective view of another preferred embodiment of the present invention.

Referring to FIG. 6 for a perspective view of another preferred embodiment of the present invention, the isothermal board 50 can be modified based on different space limitations or heat dissipation requirements of the LED module 20. This embodiment adopts a rectangular upper plate 51 engaged with a rectangular lower plate 52 disposed at the bottom of the upper plate 51. The interior of the lower plate 51, 52 is filled with capillary tissues and operating fluids to form a vacuum chamber, so as to greatly enhance the heat conduction performance.

In summation of the above description, the quick assembling structure for LED lamp and heat dissipating module in accordance with the invention herein enhances the performance than the conventional structure and further complies with the patent application requirements.

The present invention are illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A quick assembling structure for LED lamp and heat dissipating module, comprising:

an LED lamp set, comprising:

a casing, having a containing hole, a stopping member protruded from an internal edge of the containing hole, a plurality of support stands extended outward from an external edge, and a corresponding latch portion formed on an internal side of the support stand; and an LED module, contained in a containing hole of the casing, and having a base board and a plurality of LEDs fixed on the bottom surface of the base board; and a heat dissipating module, having an isothermal board disposed on a side of the support stand of the casing, and one side of the isothermal board and the base board of the LED module being attached with each other, and another side of the isothermal board being latched to a latch portion of the support stand.

2. The quick assembling structure for LED lamp and heat dissipating module of claim 1, wherein the casing forms a cone at the bottom of the casing, and the containing hole is disposed at the top surface of the cone.

3. The quick assembling structure for LED lamp and heat dissipating module of claim 2, wherein the cone includes a stairway ring disposed at the bottom of an interior of the cone.

4. The quick assembling structure for LED lamp and heat dissipating module of claim 1, wherein the stopping member of the casing includes a positioning member disposed on the top of the stopping member, and the base board of the LED module includes a stopping surface, and the stopping surface and the positioning member of the casing are attached with each other.

5. The quick assembling structure for LED lamp and heat dissipating module of claim 1, wherein the support stand is substantially in an inverted L-shape, and its short arm forms the latch portion disposed on an internal side of the short arm.

6. The quick assembling structure for LED lamp and heat dissipating module of claim 1, wherein each support stand has an inverted L-shape fixing stand disposed between the casing, a slab extended horizontally from an end of the fixing stand, and a through hole disposed at the center of the slab.

7. The quick assembling structure for LED lamp and heat dissipating module of claim 1, wherein the base board of the LED module includes a plurality of fixing holes, and each LED includes a protruding pillar extended from the rear of the LED, and the protruding pillar is embedded and coupled to the fixing hole of the base board.

8. The quick assembling structure for LED lamp and heat dissipating module of claim 1, wherein the isothermal board includes an upper plate and a pair of lower plates engaged to the bottom of the upper plate to form a vacuum chamber between the lower plates.

9. The quick assembling structure for LED lamp and heat dissipating module of claim 8, wherein the isothermal board has a wiring hole disposed at the center of the isothermal board.

10. The quick assembling structure for LED lamp and heat dissipating module of claim 1, further comprising a plurality of elastic bodies, each having a fixing section and a clamping section extended outward from the fixing section, and the casing has a through hole, and the fixing section is embedded and fixed into the through hole of the stopping member, and the clamping section is clamped between the corresponding surface of the stopping member and the base board of the LED module.

* * * * *